US008698867B2

(12) United States Patent
Tsuchiya

(10) Patent No.: US 8,698,867 B2
(45) Date of Patent: Apr. 15, 2014

(54) HOUSING IMMOBILIZING MECHANISM, IMAGE FORMING APPARATUS, AND HOUSING IMMOBILIZING METHOD

(75) Inventor: Hiroaki Tsuchiya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 25 days.

(21) Appl. No.: 13/447,216

(22) Filed: Apr. 14, 2012

(65) Prior Publication Data

US 2012/0263501 A1 Oct. 18, 2012

(30) Foreign Application Priority Data

Apr. 15, 2011 (JP) ..... 2011-090822

(51) Int. Cl.
*B41J 15/14* (2006.01)
*B41J 27/00* (2006.01)

(52) U.S. Cl.
USPC ..... 347/242; 347/257

(58) Field of Classification Search
USPC ..... 347/231, 242, 243, 257, 259–261, 263
See application file for complete search history.

(56) References Cited

U.S. PATENT DOCUMENTS 7,312,808 B2 * 12/2007 Kato et al. ..... 347/145

FOREIGN PATENT DOCUMENTS

JP 2000292730 A * 10/2000 ..... G02B 26/10
JP 2001-322311 A 11/2001

* cited by examiner

*Primary Examiner* — Hai C Pham
(74) *Attorney, Agent, or Firm* — NDQ&M Watchstone LLP

(57) ABSTRACT

A housing immobilizing mechanism has a drive source that drives at a predetermined speed; a housing for holding the drive source; a number of fasteners greater than a number of predetermined fastening sites on the housing; and an immobilizing member attached to a plurality of the fasteners, the immobilizing member adapted to immobilize the housing. The immobilizing member is attached to a combination of fasteners to which the immobilizing member is attached that is not a combination in which an amplitude of vibration relative to a drive speed of the drive source is greatest, there being at least one fastener to which an immobilizing member is not attached.

15 Claims, 12 Drawing Sheets

HOUSING IMMOBILIZING MECHANISM, IMAGE FORMING APPARATUS, AND HOUSING IMMOBILIZING METHOD

This application is based upon and claims the benefit of priority from the corresponding Japanese Patent Application 2011-090822, filed on Apr. 15, 2011, the entire contents of which are incorporated herein by reference.

BACKGROUND OF THE DISCLOSURE

1. Field of the Disclosure

The present disclosure relates to the immobilizing of a housing holding a drive source, such as a polygon motor, installed in, for example, an image forming apparatus.

2. Description of Related Art

A housing supporting a motor that rotates at high speeds may be attached to a frame. For instance, in an image forming apparatus, a polygon motor that causes a polygonal mirror to rotate at high speeds of tens of thousands of rotations per minute may be mounted on an exposure device. The exposure device may be called a laser scanner unit (LSU). An exposure device of this kind reflects laser light off of a polygonal mirror, and scans and exposes a photosensitive drum to light in order to form a latent electrostatic image. A housing of an exposure device configured as a single unit is attached to a frame within the image forming apparatus. For instance, a technique such as that described below is known in relation to the attachment and positioning of an exposure device.

Specifically, there is known an image forming apparatus that includes an image support and a light scanner unit that exposes the surface of the image support to light and forms a latent electrostatic image, wherein the light scanner unit has an optical component for exposing the surface of the image support to light and a substrate upon which the optical component is provided; the light scanner unit is capable of rotating around an axis constituted by a supporting member attached to the frame of the image forming apparatus and extending through the substrate in the primary exposure scanning direction; the light scanner unit is supported so that movement in the primary scanning direction is prevented; and the light scanner unit is supported at a first support in the vicinity of one end of the supporting member, a second support in the vicinity of another end of the supporting member, and a third support that checks the rotation of the light scanner unit. This configuration is meant to prevent deformation of the light scanner unit while supporting and positioning same, maintaining high optical performance.

A motor (drive source), such as a polygon motor, that rotates at high speed possesses high levels of energy, which leads to vibration. The greater the amplitude of this vibration generated by the drive source becomes due to resonance, the greater the lens or polygonal mirror vibrates. The vibration can become great enough to shift the position on the photosensitive drum being irradiated with laser light, negatively affecting the quality of the formed image.

The same type of exposure device may be commonly installed in a plurality of models of image forming apparatus. The rotational speed of a motor such as the polygon motor is not always identical for each model of image forming apparatus. The rotational speed of the motor often varies according to the specifications of the various models of image forming apparatus. Generally, the greater the number of sheets printed per unit of time by a model, the higher the speed at which the polygon motor rotates. In inexpensive models, from which the same number of sheets printed per unit of time as that yielded by more expensive models is not expected, the rotational speed of the polygon motor is lower than that of more expensive models.

In this way, the rotational speed of the motor of an image forming apparatus varies from model to model, even when the same type of exposure device is installed. For this reason, the frequency of the vibration appearing in the housing of the exposure device varies from model to model due to the difference in motor rotational speeds. The housing is immobilized in place by a fastener or the like, reducing vibration to a certain degree. However, it may not be possible to completely eliminate the vibration generated by the motor depending on the positional relationship between the fastener site and the drive source, the shape and/or material of the housing, and the frequency of the vibration. For this reason, while the specifications (motor rotational speed) of some models might cause no problem with vibration, in the specifications of other models, vibration may be generated to such an extent that the image may be affected (i.e., beyond an acceptable degree) unless the vibration is stopped.

When vibration occurs beyond an acceptable degree, a preventative measure of adding a vibration damping member to the lens, mirror, and other members within the exposure device has conventionally been adopted in order to suppress vibration. The vibration damping member might be, for example, a weight, a plate (metal plate), a damping sheet (soft sheet) that cancels out vibration by converting the vibration to heat, or the like. However, the addition of a vibration damping member has presented the problem of increasing manufacturing costs through the cost of the vibration damping member itself and/or an increase in man-hours.

Also, the image forming apparatus described above does not provide against vibrations caused by a motor such as a polygon motor. For this reason, a problem has been presented in that vibration increases depending on the rotational speed of the polygon motor.

SUMMARY OF THE DISCLOSURE

In view of the problems described above, the present disclosure effectively suppresses vibration even when the same housing is installed in various models, while seeking to reduce manufacturing costs by not adding a vibration damping member.

In order to achieve the object described above, a housing immobilizing mechanism according to a first aspect of the present disclosure has a drive source; a housing for holding the drive source; a number of fasteners greater than a number of predetermined fastening sites on the housing; and an immobilizing member attached to the fasteners in order to immobilize the housing a combination of fasteners to which the immobilizing member is attached that is not a combination in which an amplitude of vibration relative to a drive speed of the drive source is greatest, there being at least one fastener to which an immobilizing member is not attached.

This enables vibration to be effectively suppressed, even when the same housing is installed in various models, while manufacturing costs are reduced by not adding a vibration damping member.

Further features and advantages of the present disclosure will become apparent from the description of embodiments given below.

DETAILED DESCRIPTION OF PREFERRED EMBODIMENTS

Figure 1:
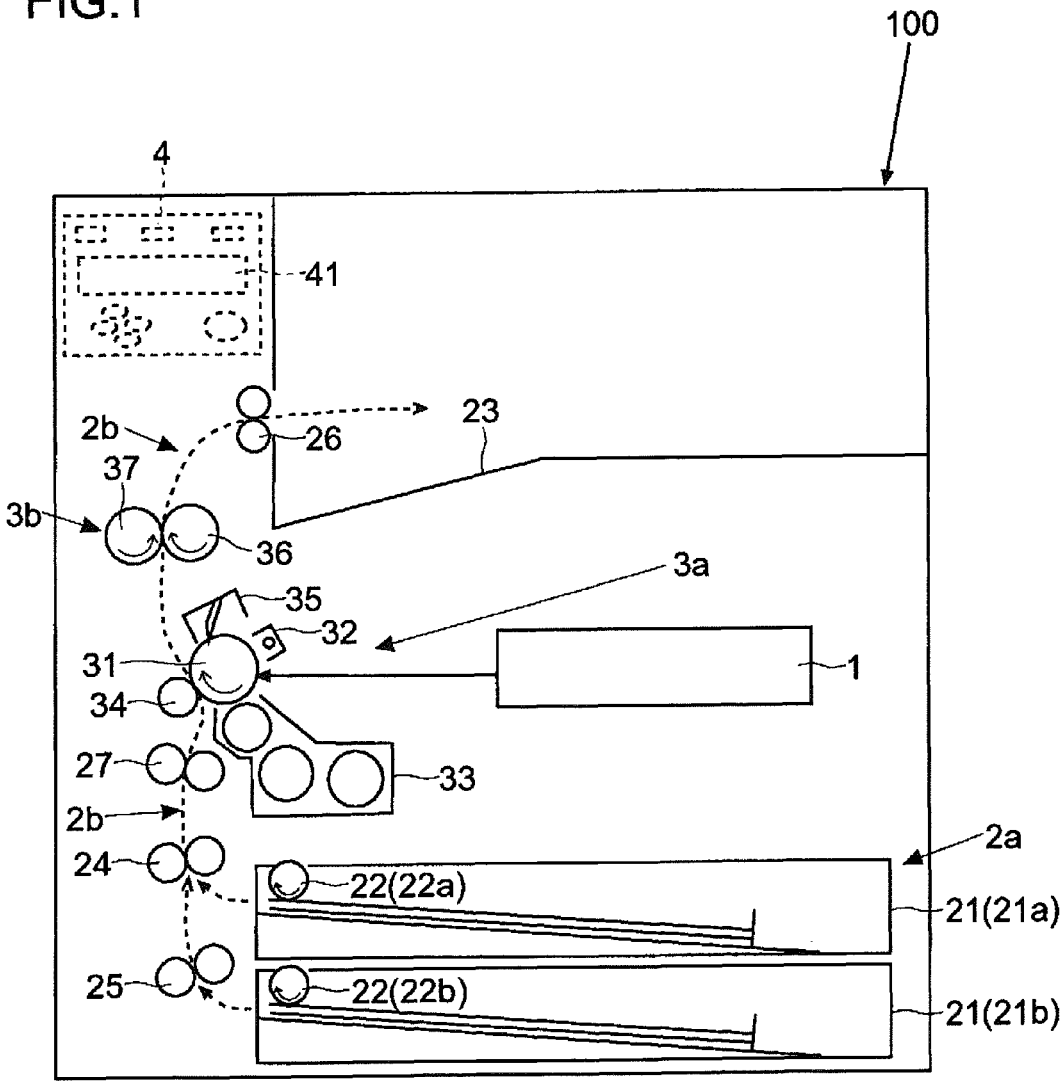
FIG. 1 is a schematic front cross-sectional view of a rough structure of a printer.

There follows a description of an embodiment of the present disclosure with reference to FIGS. 1 through 14. A first embodiment will first be described with reference to FIGS. 1 through 10. The following embodiment describes an example of a housing 7 of an exposure device 1 being immobilized on a frame 6 of a printer 100 (constituting an image forming apparatus) as one example of an image forming apparatus. However, the various elements of the embodiment, such as configuration, arrangement, and the like, are merely for the sake of illustration, and in no way limit the scope of the disclosure.

(Overview of a Printer 100)

First, an outline of a printer according to a first embodiment will be described with reference to FIG. 1. FIG. 1 is a schematic front cross-sectional view of a rough structure of a printer 100.

As shown in FIG. 1, the printer 100 of this embodiment has therein, along with an exposure device 1, a paper feeder 2*a*, a paper path 2*b*, an image forming part 3*a*, and a fuser 3*b*. As shown by the dotted lines, a control panel 4 is provided on an upper portion of the printer 100.

The paper feeder 2*a* feeds paper toward the image forming part 3*a*. The paper feeder 2*a* includes a cassette 21 (in FIG. 1, an upper cassette is labelled 21*a*, and a lower one is labelled 21*b*) containing paper of various sizes. The paper feeder 2*a* has a paper feeding roller 22 (in FIG. 1, an upper roller is labelled 22*a*, and a lower one is labelled 22*b*) or the like that feeds one sheet of paper at a time from the cassette 21 into the paper path 2*b*. When printing is performed, a motor (not illustrated) or the like drives the paper feeding roller 22 to rotate, and paper is fed into the paper path 2*b*.

The paper path 2*b* conveys the paper through the image forming part 3*a* and fuser 3*b* to a delivery tray 23. A guide (not illustrated), a plurality of pairs of feed rollers 24 and 25, and a pair of delivery rollers 26 are provided along the paper path 2*b*. A pair of registration roller 27 for feeding the paper in synchronization with the formation of a toner image in the image forming part 3*a* is also provided along the paper path 2*b*.

The image forming part 3*a* forms a toner image on the image support, and transfers the toner image to paper fed along the paper path 2*b*. Specifically, the image forming part 3*a* is supported so as to be rotatable in the direction of an arrow shown in FIG. 1, and includes a photosensitive drum 31 as an image support. The image forming part 3*a* has an electrostatic device 32 disposed around the periphery of the photosensitive drum 31, a developer device 33, an exposure device 1, a transfer roller 34, and a cleaning device 35. The photosensitive drum 31 is provided roughly in the center of the image forming part 3*a*, and is driven to rotate in a predetermined direction. The electrostatic device 32 evenly imparts the surface of the photosensitive drum 31 with an electrostatic charge of a predetermined potential. The exposure device 1 outputs laser light based on image data, and scans and exposes the photosensitive drum 31. As a result, a latent electrostatic image is formed on the surface of the photosensitive drum 31. The exposure device 1 will be described in detail below.

Next, the developer device 33 supplies toner to the latent electrostatic image. As a result, the latent electrostatic image is developed as a toner image. A nip is formed between the transfer roller 34 and the photosensitive drum 31, and when paper passes through this nip, the toner image on the photosensitive drum 31 is transferred to the paper. The cleaning device 35 cleans the surface of the photosensitive drum 31 after the image has been transferred.

The fuser 3*b* fuses the transferred toner image to the paper. The fuser 3*b* of this embodiment is primarily composed of a heating roller 36 containing a heat generating body therein and a pressure roller 37 that presses against the heating roller 36 to fouls a nip. When the paper onto which the toner image has been transferred passes through this nip, the toner is heated and melted, and the toner image is fused to the paper.

(Hardware Configuration of the Printer 100)

Figure 2:
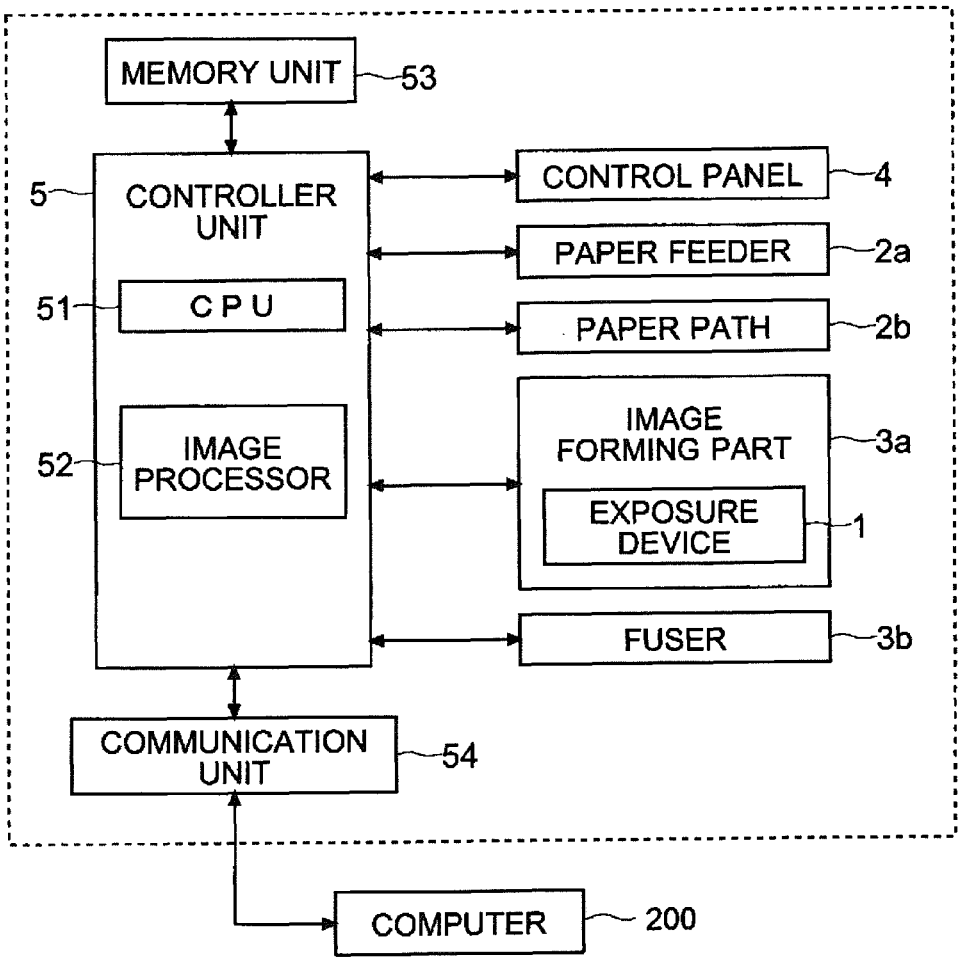
FIG. 2 is a block diagram illustrating one example of a hardware configuration of a printer.

Next, an example of a hardware configuration of the printer 100 according to the first embodiment will be described with reference to FIG. 2. FIG. 2 is a block diagram illustrating one example of a hardware configuration of a printer 100.

As shown in FIG. 2, the printer 100 according to this embodiment contains a controller unit 5 (control circuit board) therein. The controller unit 5 regulates the overall operation of the devices, and is in charge of controlling the various parts of the printer 100. The controller unit 5 is provided with, for example, a CPU 51 as a central processing device and an image processor 52.

The printer 100 is provided with a memory unit 53 made up of memory devices such as ROM, RAM, and/or an HDD. An execution program for controlling the CPU 51, a boot program, and/or various types of control data such as parameters unique to each device are stored in the memory unit 53. The controller unit 5 engages in control based on the programs and/or data stored in the memory unit 53.

The printer 100 includes a communication unit 54 as a communication interface with the exterior. The communication unit 54 communicates with, for example, an external computer 200 (e.g., a personal computer and/or server) via a network and/or cables. The communication unit 54 includes a connector for directly connecting, for example, a network connection and/or the printer 100 to the computer 200, a controller for controlling communication, and a chip. The communication unit 54 receives printing data from the computer 200 or the like, including image data and/or print setting data. The controller unit 5 causes the image forming part 3*a* and exposure device 1 to print based on the image data.

The controller unit 5 is communicably connected with the paper feeder 2*a*, paper path 2*b*, image forming part 3*a*, and fuser 3*b*, which actually perform the paper feeding and printing processes. The controller unit 5 controls processes such as the rotation of the various rotating bodies (paper feeding rollers, photosensitive drum 31, etc.) used in feeding the paper and forming the image.

The controller unit 5 is also communicably connected with the control panel 4 via a bus or the like. For example, the controller unit 5 controls the display of an LCD 41 of the control panel 4 (see FIG. 1), and detects strokes of the various keys on the control panel 4. Setting-dictating data input from the control panel 4 is sent to the controller unit 5, and the controller unit 5 controls the printer 100 so as to operate according to user-dictated settings.

The controller unit 5 includes an image processor 52 that performs various imaging processes on the image data. The image processor 52 may be provided outside of the controller unit 5. The image processor 52 includes, for example, an ASIC as a dedicated image processing circuit, image processing memory, and the like. The image processor 52 performs various imaging processes upon the image data such as, for example, changes in saturation and/or magnification/shrinking. Because the image processor 52 is capable of performing a wide range of imaging processes, it will be considered capable of performing publicly known image processes, and detailed descriptions of executable imaging processes will be omitted.

The image processor 52 converts the image data to a format capable of being used by the exposure device 1, and sends the image data to the exposure device 1. For example, the image processor 52 converts the image data into data directing the illumination of a semiconductor laser device 11 for each pixel, and sends the data to the exposure device 1. Based on the sent data, the exposure device 1 lights the semiconductor laser device 11, and scans and exposes the photosensitive drum 31.

(Outline of the Exposure Device 1)

Figure 3:
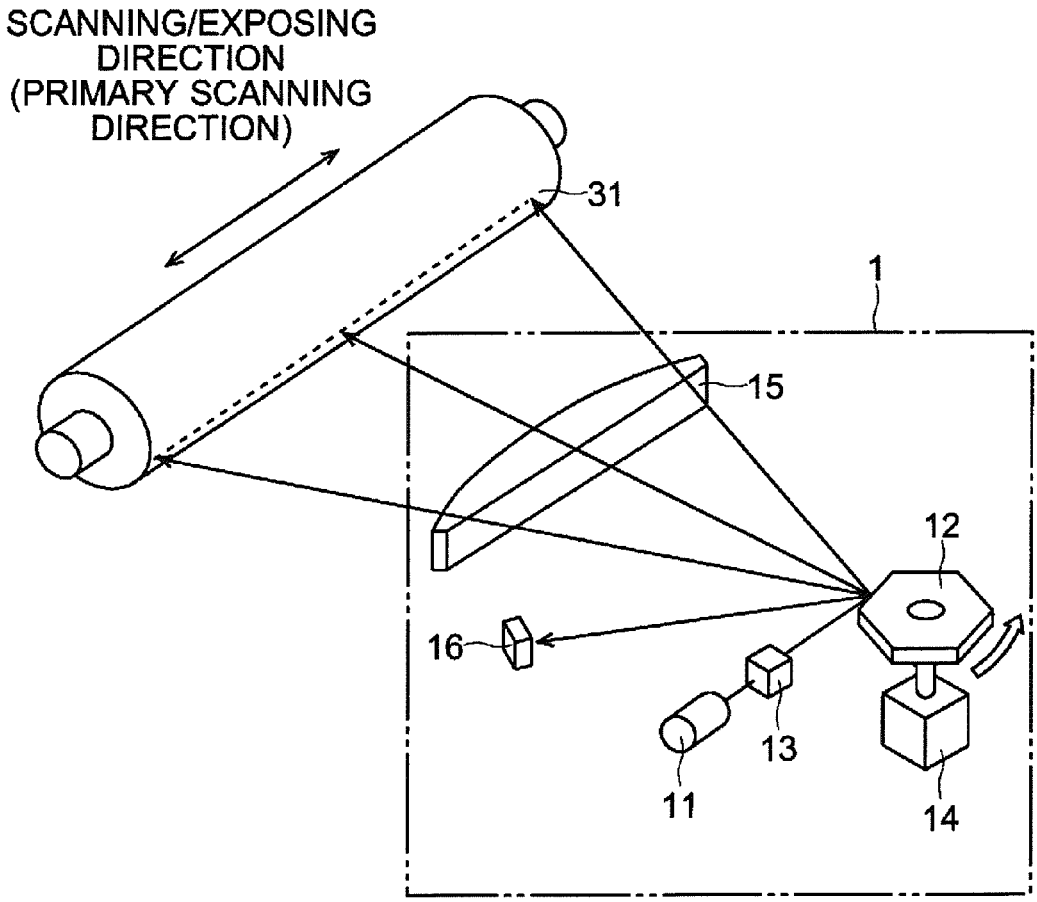
FIG. 3 is a schematic view of one example of an exposure device.

Next, an example of an exposure device 1 according to the first embodiment will be described with reference to FIG. 3. FIG. 3 is a schematic view of one example of an exposure device 1.

As shown in FIG. 3, the exposure device 1 includes a semiconductor laser device 11 (e.g., a laser diode); a lens 13 provided between the semiconductor laser device 11 and a polygonal mirror 12; a polygonal mirror 12, having a plurality of flat reflective surfaces that reflect laser light, that is driven by a polygon motor 14 (equivalent to a drive source); and an fθ lens 15 yielding a immobilized scanning speed of the laser light over the photosensitive drum 31, and the like.

The exposure device 1 is provided with a light receiving unit 16 disposed inside the range of laser light irradiated (scanning range) by the polygon motor 14 and outside the irradiation range of the photosensitive drum 31. An output current (output voltage) of the light receiving unit 16 changes upon being irradiated with laser light. The light receiving unit 16 is a circuit including a light-receptive element (e.g., a photodiode). The timing by which the photosensitive drum 31 is exposed (imprinted) is determined based on the output of the light receiving unit 16.

(Housing 7 of the Exposure Device 1)

Figure 4:
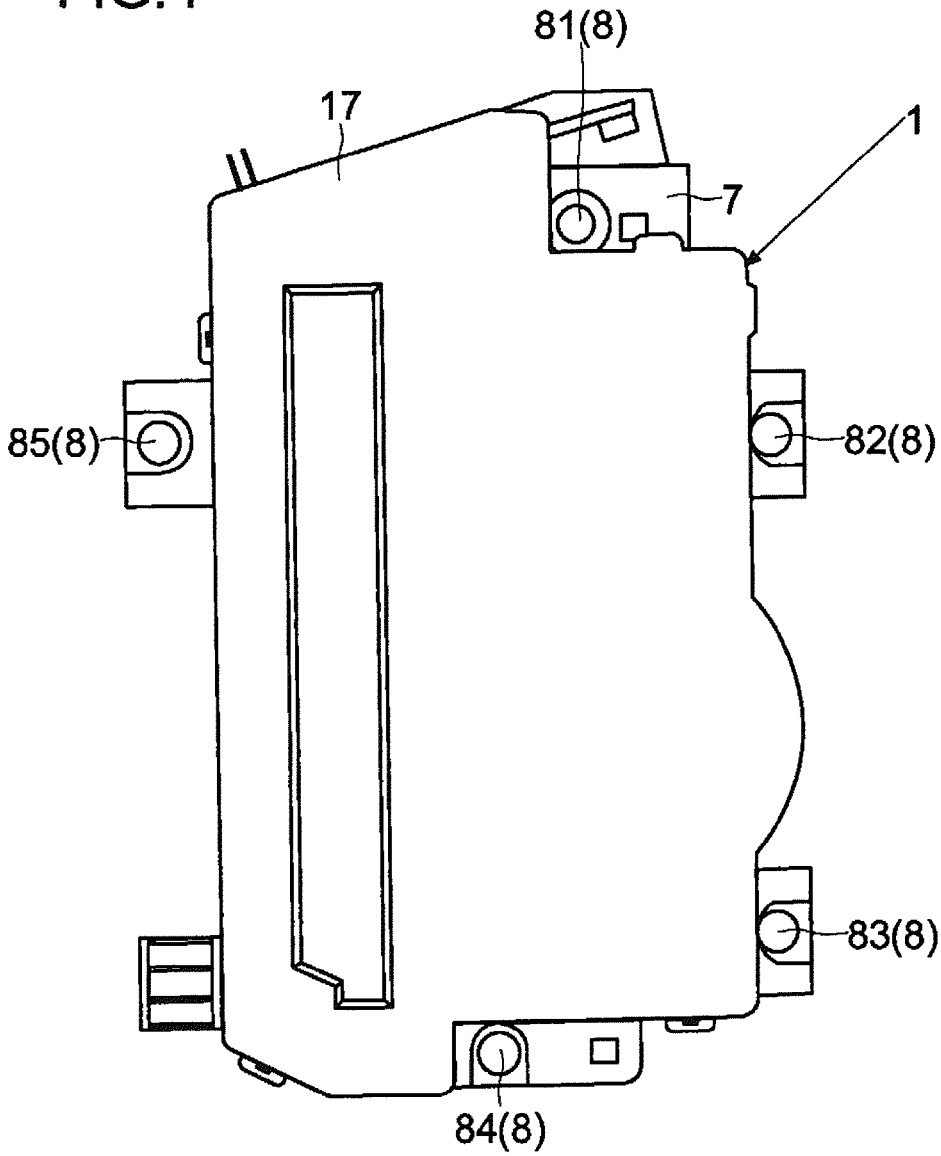
FIG. 4 is an overhead view of an exposure device to which a cover is attached as seen from above.
Figure 5:
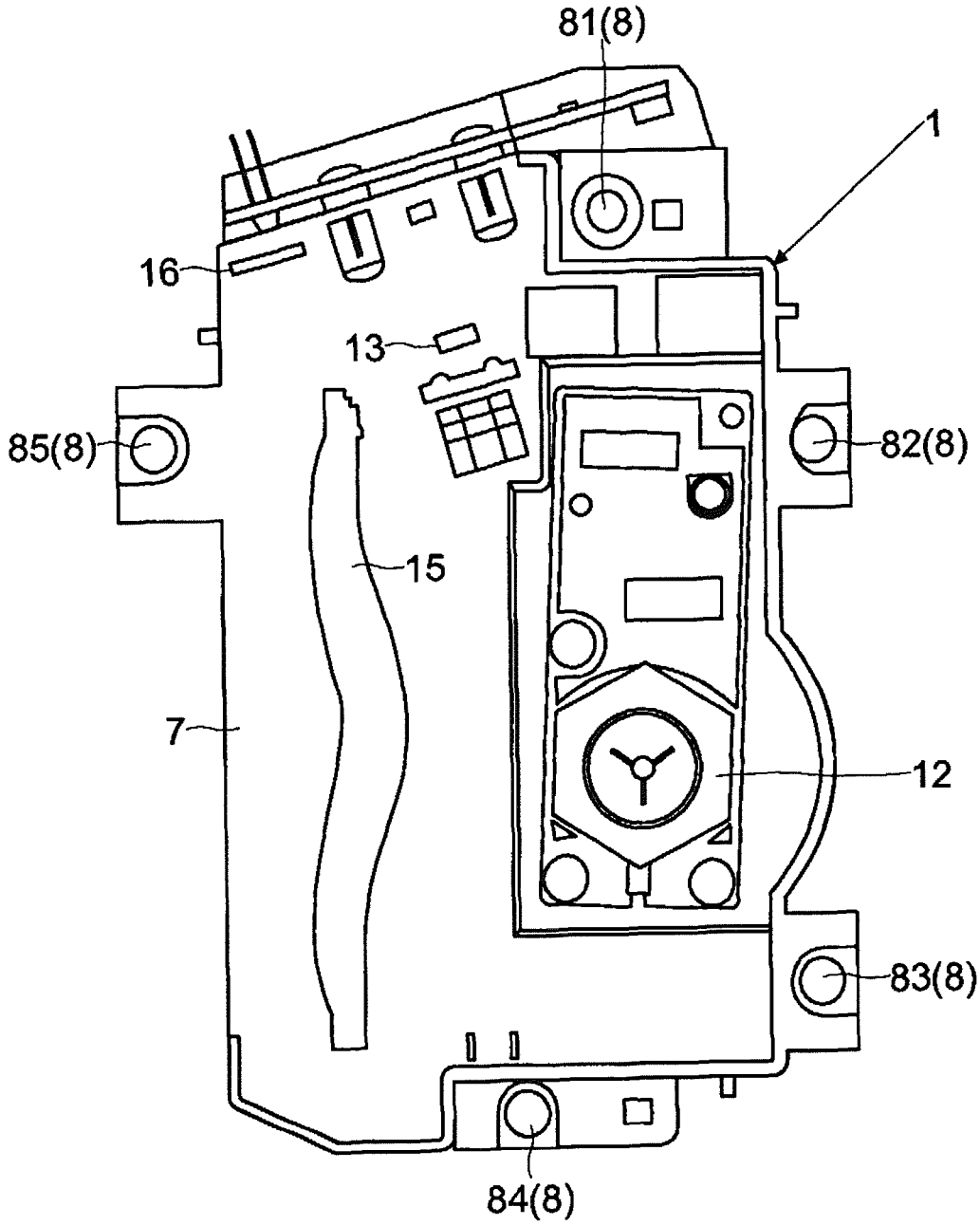
FIG. 5 is an overhead view of an exposure device from which a cover has been removed as seen from above.

Next, the exposure device 1 according to the first embodiment will be described in detail with reference to FIGS. 4 and 5. FIG. 4 is an overhead view of an exposure device 1 to which a cover 17 is attached as seen from above. FIG. 5 is an overhead view of an exposure device 1 with a cover 17 removed as seen from above.

As shown in FIG. 4, the exposure device 1 constitutes a single unit. A cover 17 is attached thereto to reduce the intrusion of dust and the like. The cover 17 is a part of the exposure device 1, and is made of, for instance, resin.

FIG. 5 shows an exposure device 1 with a cover 17 removed. The exposure device 1 includes a housing 7 that supports the various members within the exposure device 1. As shown in FIG. 5, the housing 7 is made of, for example, resin, and supports the polygonal mirror 12, fθ lens 15, lens 13, light receiving unit 16, and the like described above. In FIG. 5, no polygon motor 14 is visible, but a polygon motor 14 is attached beneath the polygonal mirror 12.

The housing 7 has five fasteners 8 used to fasten the housing to a frame 6 of the printer 100. While each of the fasteners 8 is identical, for convenience, the fasteners 8 in FIG. 5 will be labelled 81, 82, 83, 84, and 85 going clockwise from the topmost fastener 8. Hereafter, in all descriptions pertaining equally to the fasteners 81 through 85, the numbers 1, 2, 3, 4, and 5 will be omitted, and reference will be made merely to a fastener 8.

In this embodiment, four fasteners 8 (fasteners 82 through 85) that project from an end of the housing 7 are provided at roughly an outer edge of the housing 7. A fastener 8 (fastener 81) is provided somewhat to the inside of the outer edge of the housing 7 at a position above the circuit board of the polygon motor 14 in FIG. 5. Each fastener 8 has an opening.

(Outline of Immobilizing the Exposure Device 1 on the Frame 6)

Figure 6:
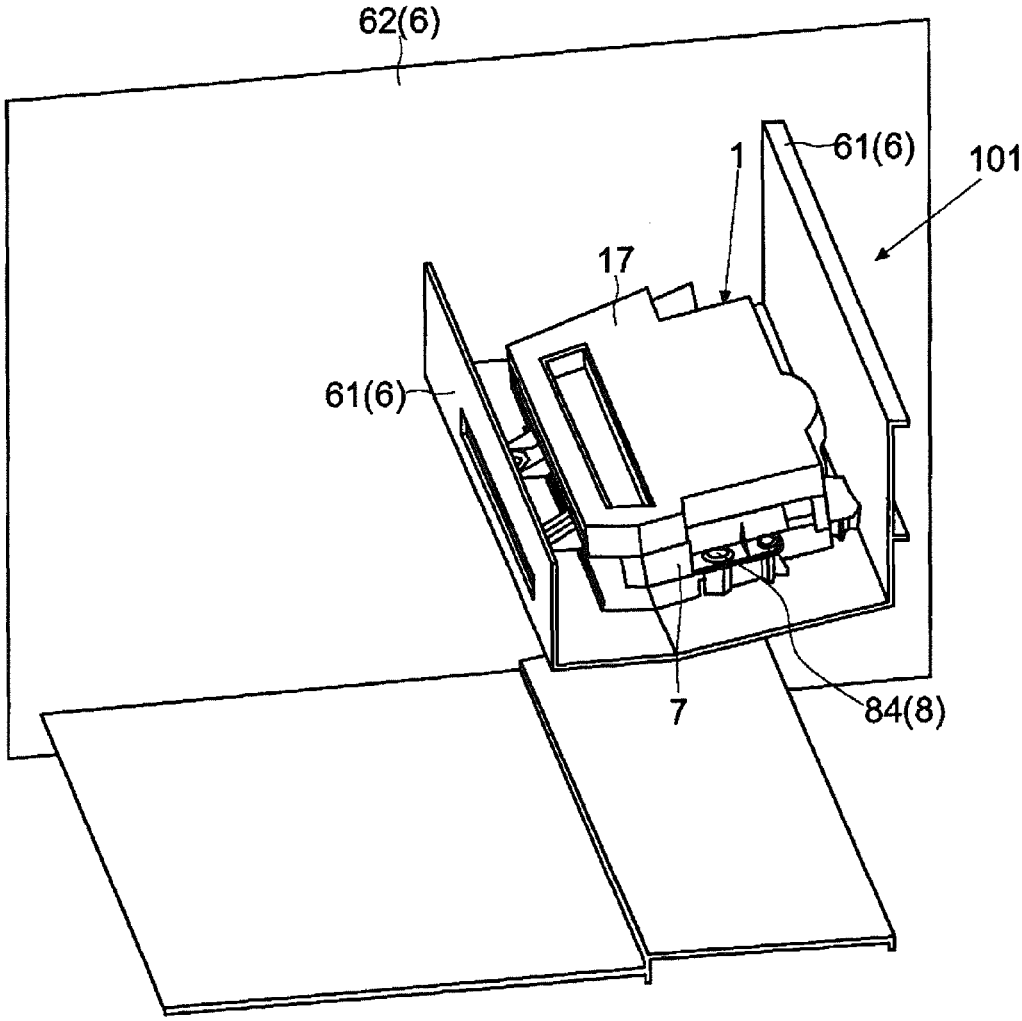
FIG. 6 is a perspective view of one example of the immobilizing of an exposure device.
Figure 7:
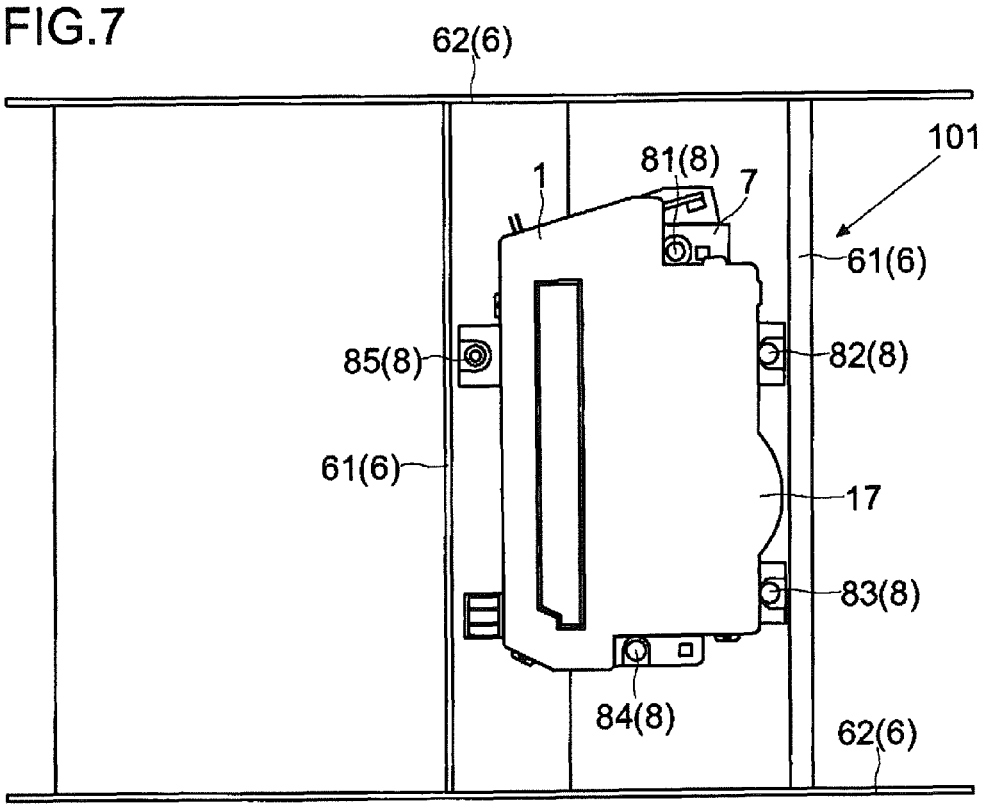
FIG. 7 is an overhead view of one example of the immobilizing of an exposure device.
Figure 8:
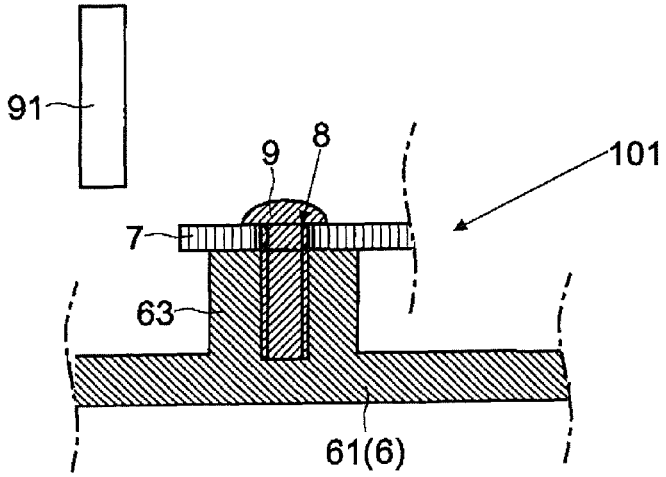
FIG. 8 is a cross-sectional view of one example of immobilizing using an immobilizing member.

Next, an outline of immobilizing the exposure device 1 according to the first embodiment on the frame 6 will be described with reference to FIGS. 6 through 8. FIG. 6 is a perspective view of one example of the immobilizing of an exposure device 1. FIG. 7 is an overhead view of one example of the immobilizing of an exposure device 1. FIG. 8 is a cross-sectional view of one example of immobilizing using an immobilizing member 9.

In FIGS. 6 and 7, the frame 6 within the printer 100 has been simplified for illustration (it is ordinarily more complex). Within the printer 100 is provided an exposure device frame 61 used to immobilize the exposure device 1. The exposure device frame 61 has a roughly U-shaped cross section viewed from the front. An aperture is provided in the exposure device frame 61 so that laser light reaches the photosensitive drum 31 (see FIG. 6).

An immobilizing member 9 is attached to a fastener 8 of the housing 7 of the exposure device 1. This immobilizes the exposure device 1 on the exposure device frame 61. In other words, by passing the immobilizing member 9 through the fastener 8 and linking the immobilizing member 9 and the exposure device frame 61, the exposure device 1 is immobilized on the exposure device frame 61. As shown in FIG. 7, the exposure device 1 is immobilized so as to be encompassed by a wall of the exposure device frame 61 and a body frame 62.

The frame 6 is provided with an immobilizing indentation 63 at a position corresponding to each fastener 8 of the housing 7 when the exposure device 1 is set in a suitable attachment position. An example of an immobilized state using the immobilizing member 9 will be described with reference to FIG. 8.

In this embodiment, a screw, for example, is used for the immobilizing member 9. When fastening is performed with the immobilizing member 9, the immobilizing member 9 is passed through the aperture of the fastener 8, and a tip of the immobilizing member 9 is pushed into the immobilizing indentation 63 of the frame 6. In practice, an immobilizing member 9 is attached to a fastener 8 at a minimum of three of the plurality of fasteners 8 in order to ensure the immobilizing of the exposure device 1 in the printer 100 of this embodiment.

The immobilizing member 9 is not limited to a screw as long as it is capable of immobilizing the exposure device 1; a configuration using a bolt or other type of fastener may also be adopted (in this case, the shape of the frame 6 will vary according to the immobilizing member 9 used).

(Relationship Between the Fasteners 8 Used and Vibration in the Housing 7)

Figure 9A:
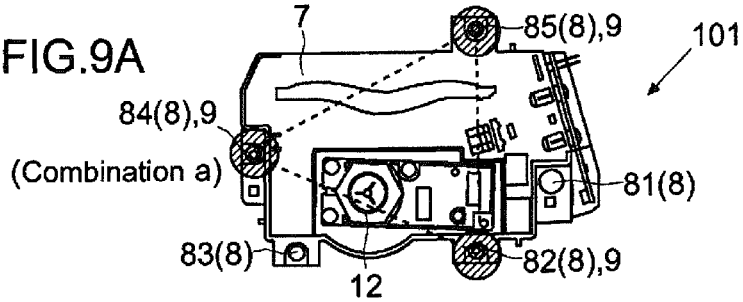
FIG. 9A is an illustrative view of one example of a combination a of fasteners used to immobilize a housing.
Figure 9B:
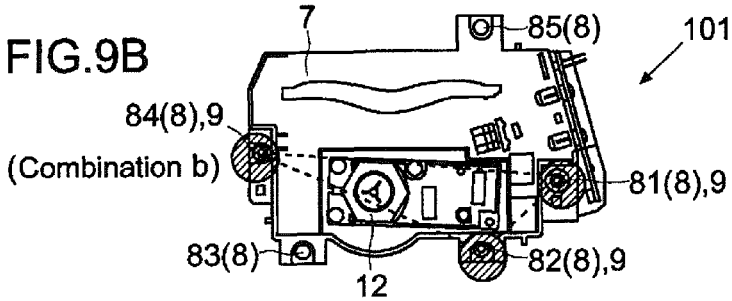
FIG. 9B is an illustrative view of one example of a combination b of fasteners used to immobilize a housing.
Figure 9C:
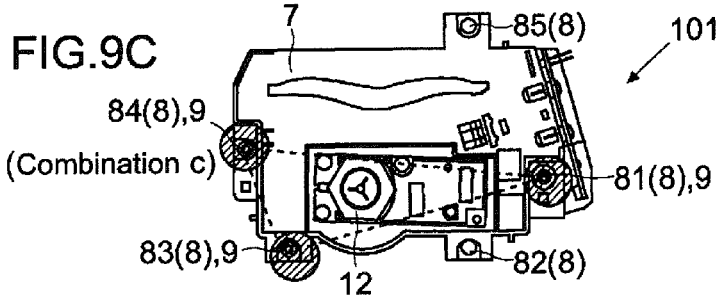
FIG. 9C is an illustrative view of one example of a combination c of fasteners used to immobilize a housing.
Figure 9D:
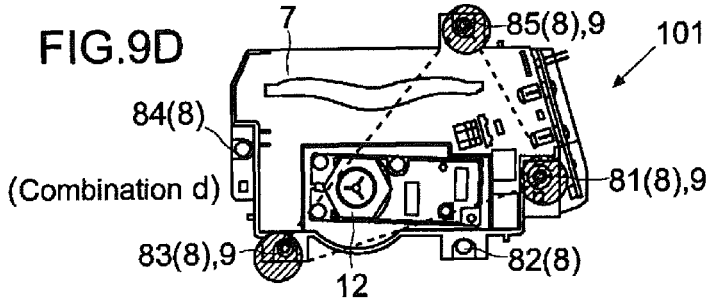
FIG. 9D is an illustrative view of one example of a combination d of fasteners used to immobilize a housing.
Figure 9E:
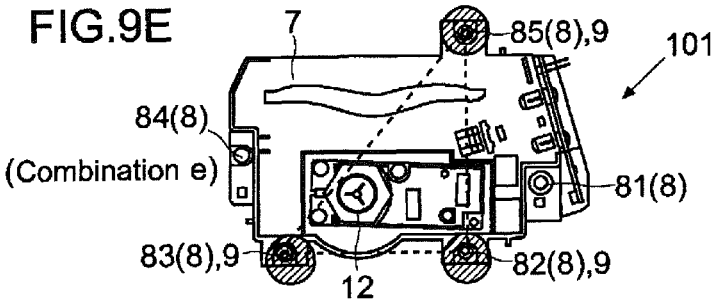
FIG. 9E is an illustrative view of one example of a combination e of fasteners used to immobilize a housing.
Figure 10:
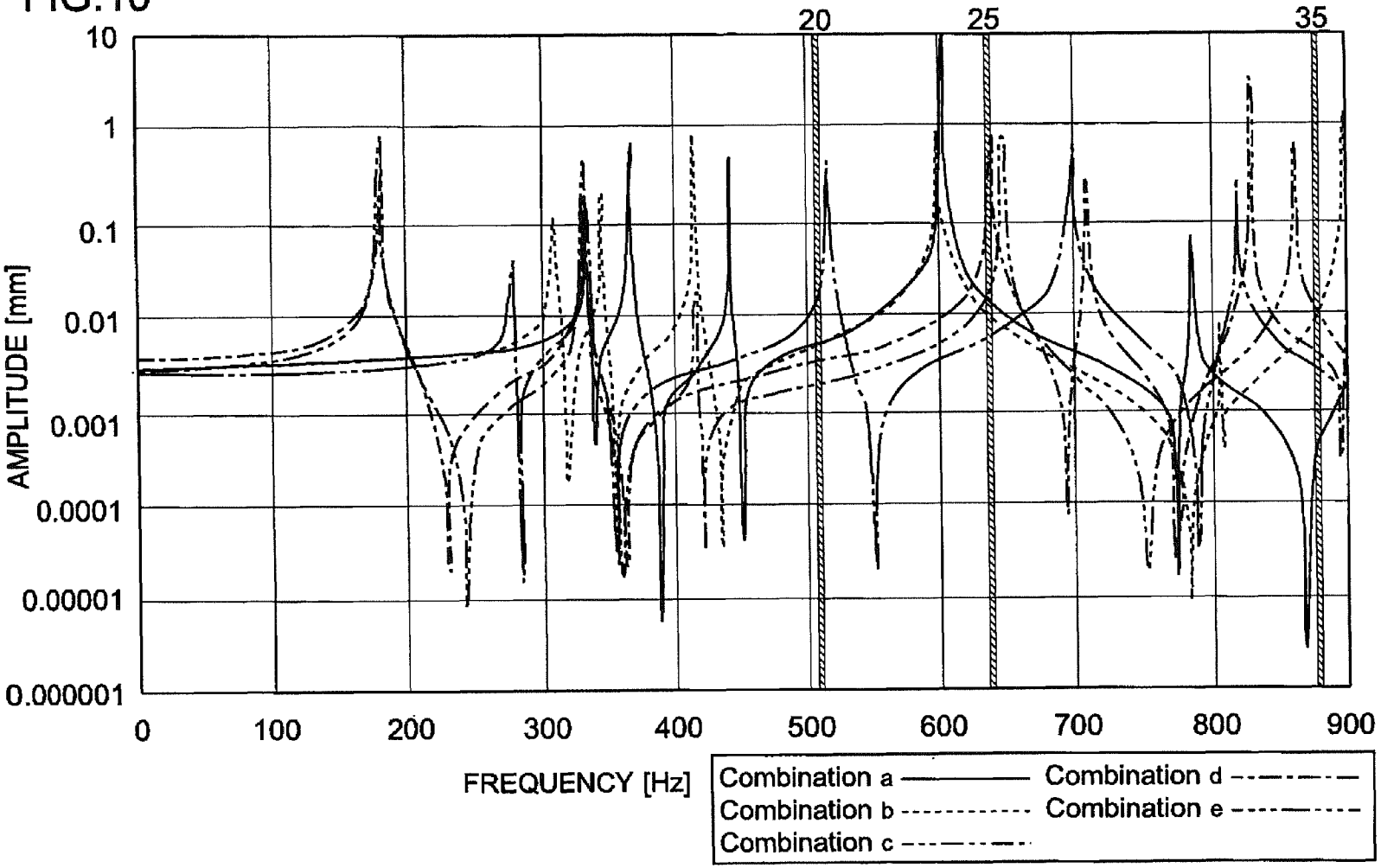
FIG. 10 is a graph illustrating one example of an amplitude of vibration generated in a housing as the drive speed of a polygon motor increases for each combination of fasteners used to immobilize the housing.

Next, the relationship between the fasteners 8 used in the first embodiment and vibration in the housing 7 will be described with reference to FIGS. 9A through 9E and FIG. 10. FIGS. 9A through 9E are illustrative views of one example of a combination of fasteners 8 used to immobilize a housing 7. FIG. 10 is a graph illustrating one example of an amplitude of vibration generated in a housing 7 as the drive speed of a polygon motor 14 increases for each combination of fasteners 8 used to immobilize the housing 7.

First, vibration generated by the polygon motor 14 will be described. A polygon motor 14 is supported by the housing 7 of the exposure device 1. The polygon motor 14 rotates the polygonal mirror 12 at high speeds (e.g., between 20,000 and 50,000 rpm). Because of this high-speed rotation, the polygon motor 14 has a great amount of energy, and acts as a source of vibration in the exposure device 1 (housing 7). As this vibration increases, picture quality is affected through shifts in the laser light irradiation position or the like.

It is evident that whether or not the exposure device 1 (housing 7) vibrates beyond an acceptable degree depends upon the speed of the polygon motor 14 and the positions of the fasteners 8 to which immobilizing members 9 are attached (fastening sites).

A specific (unique) frequency of vibration caused by vibration generated by the polygon motor 14 and resonance therewith governs vibration of the housing 7. The rotational speed of the polygon motor 14 determines at which (unique) frequency vibration occurs (the governing frequency of vibration). Typically, the exposure device is fastened at three points or so and immobilized on a frame or the like within the image forming apparatus. The immobilization achieved by the fasteners has the effect of suppressing vibration to a certain degree. However, there is a frequency of vibration that cannot be completely suppressed (i.e., vibration occurring beyond the acceptable limit) even when such fastening-assisted immobilization is performed (depending on factors such as the position of the polygon motor or the shape/material/etc. of the housing).

In the case of an image forming apparatus such as a printer or a multifunction peripheral, a series of models with different prices and functions can be sold wherein a common member can be used to a certain degree. As such, a developed exposure device may be installed in a plurality of models. In the case of the applicant, it is possible for the exposure device 1 of this embodiment to be installed in a plurality of types of printer and/or multifunction peripheral having different functions. For example, in various models forming a series, there is a difference in the number of sheets that can be printed per unit of time depending on price level, energy consumption level, and the like.

For example, it shall be assumed that the exposure device 1 is used in each of a series of models, which are capable of printing twenty-five, thirty, thirty-five, forty, and fifty sheets (size: A4; likewise hereafter) per minute, respectively. The greater the number of sheets printed per unit of time, the faster the paper feeding speed becomes, and the faster the rotational speed (peripheral speed) of the various rotating bodies such as the photosensitive drum 31 and/or the pair of delivery rollers 26. In order to handle the increased speed, the rotational speed of the polygon motor 14 of the exposure device 1 likewise increases as the number of sheets printed per unit of time according to the specifications increases.

For this reason, while vibration is comparatively suppressed in some models, there are cases where it is not possible to completely suppress vibration due to the difference in vibrational frequency generated by the difference in the rotational speed of the polygon motor 14.

Conventionally, the sites where the housing is fastened to the frame (fastening sites) are immobilized. However, because the rotational speed of the polygon motor varies from model to model, even when vibration can be kept within an acceptable level in some models, there are cases where the vibration of the housing cannot be kept within an acceptable level in other models. Conventionally, when an unacceptable level of vibration occurs, there has been no recourse other than to add a vibration damping member such as a weight, plate, damping sheet (soft sheet), or the like in order to dampen the vibration.

In the exposure device 1 of this embodiment, the fasteners 8 to which an immobilizing member 9 is attached are varied according to the rotational speed of the polygon motor 14, and a combination of fasteners 8 capable of suppressing vibration was actively selected to immobilize the exposure device 1 (housing 7) to the frame 6. Thanks to this, the addition of a vibration damping member is unnecessary.

The method will be described with reference to FIGS. 9A through 9E and FIG. 10. Generally, positioning can be determined when immobilizing at three points is possible. When an immobilizing member 9 is not attached to all fasteners 8, and a minimum of three sites are fastened, a minimum of four fasteners 8 are needed.

As was described with reference to FIG. 5, the housing 7 of this embodiment is provided with another fastener 8 in addition to these four for a total of five (fasteners 81 through 85). When immobilizing the frame 6 of the housing 7 of this embodiment, an immobilizing member 9 is attached to three of the five fasteners 8 according to the rotational speed of the polygon motor 14. This both allows the exposure device 1 to be suitably immobilized and the number of immobilizing members 9 used to be reduced, reducing the man-hours necessary for immobilizing.

A positioning member 91 is inserted into each fastener 8 to which an immobilizing member 9 is not attached, and the fasteners 8 to which an immobilizing member 9 is not attached may be used to position the housing 7 of the exposure device 1. FIG. 8 illustrates an example of a positioning member 91 for reference. For example, the positioning member 91 is a removable pin or rod that is inserted in the opening of the fastener 8 and the immobilizing indentation 63 of the frame 6. There is accordingly no need to provide a separate positioning opening or member on the housing 7 and/or the frame 6.

In this embodiment, as shown in FIGS. 9A through 9E, of the combinations of fasteners 8, the combination that is a candidate for use fulfils a certain rule. The rule is that a combination of fasteners 8 is adopted wherein, seen from the direction from which the immobilizing member 9 is immobilized (from above the exposure device 1), three (adjacent) fasteners 8 out of the five fasteners 8 to which an immobilizing member 9 is attached form a polygon (triangle) in which the rotational axis of the polygon motor 14 (polygonal mirror 12) is located. Formulaically speaking, there are twenty combinations of three fasteners selectable from among the five fasteners. However, the rule described above narrows down the number of combinations of fasteners 8. In FIGS. 9A through 9E, dotted lines connect the fasteners 8 to which an immobilizing member 9 is attached in order to show the fastening sites. Through this, it is easier to suppress the vibration generated in the polygon motor 14.

In the following description, the fastening pattern fainted by the combination of fasteners 8 used in FIG. 9A (fastener 82, fastener 84, and fastener 85) will be labelled combination a. The fastening pattern formed by the combination of fasteners 8 used in FIG. 9B (fastener 81, fastener 82, and fastener 84) will be labelled combination b. The fastening pattern formed by the combination of fasteners 8 used in FIG. 9C (fastener 81, fastener 83, and fastener 84) will be labelled combination c. The fastening pattern formed by the combination of fasteners 8 used in FIG. 9D (fastener 81, fastener 83, and fastener 85) will be labelled combination d. The fastening pattern formed by the combination of fasteners 8 used in FIG. 9E (fastener 82, fastener 83, and fastener 85) will be labelled combination e.

FIG. 10 is a graph showing one example of the relationship between the frequency of the vibration (horizontal axis) exhibited in the exposure device 1 (housing 7) and the amplitude thereof (vertical axis) at the fastening sites of each combination when the drive speed (rotational speed) of the polygon motor 14 is progressively altered. In FIG. 10, the relationship between vibrational frequency and amplitude for the fastening sites of combination a is shown by a solid line, for combination b by a dotted line, for combination c by a double-dotted-single-dashed line, for combination d by a single-dotted-single-dashed line, and for combination e by a triple-dotted-single-dashed line.

The striped line labelled 20 illustrates the frequency of the vibration exhibited by the housing 7 (approx. 510 Hz) when the polygon motor 14 is caused to rotate at a predetermined speed corresponding to a model whose specifications permit twenty sheets to be printed per minute. The striped line labelled 25 illustrates the frequency of the vibration exhibited by the housing 7 (approx. 630 Hz) when the polygon motor 14 is rotated at a predetermined speed corresponding to a model whose specifications permit twenty-five sheets to be printed per minute. The striped line labelled 35 illustrates the frequency of the vibration exhibited by the housing 7 (approx. 880 Hz) when the polygon motor 14 is rotated at a predetermined speed corresponding to a model whose specifications permit thirty-five sheets to be printed per minute. The rotational speed of the polygon motor 14 of the twenty-sheet model is less than that of the twenty-five sheet model, which is less than that of the thirty-five sheet model.

In the case of, for example, a model whose specifications allow twenty sheets to be printed per minute, vibrational amplitude is greatest when combination c (double-dotted-single-dashed line) is used for fastening. On the other hand, when combination d (single-dotted-single-dashed line) or combination e (triple-dotted-single-dashed line) is used, the amplitude of the vibration of the housing 7 is reduced (approx. 1/10) compared to when combination c is used.

On the other hand, in the case of for example, a model whose specifications allow thirty-five sheets to be printed per minute, fastening using combination b (dotted line) or combination e (triple-dotted-single-dashed line) should be avoided due to the relationship with vibration, and fastening using combination a (solid line) is most preferable.

Moreover, in the case of, for example, a model whose specifications allow twenty-five sheets to be printed per minute, fastening using combination d (single-dotted-single-dashed line) or combination e (triple-dotted-single-dashed line) should be avoided due to the relationship with vibration. Fastening using combination b (dotted line) or combination c (double-dotted-single-dashed line) is most preferable.

In this embodiment, a number of fasteners 8 greater than a predetermined number of fasteners is provided. The fasteners 8 that are used for fastening (by attaching an immobilizing member 9) can be determined as desired according to the rotational speed of the polygon motor 14 in each model. It is preferable to use a combination of fasteners 8 such that vibration is maximally suppressed at the speed of the polygon motor 14 for each model. When, however, vibration remains within an acceptable limit, for example, fastening of the exposure device 1 (housing 7) may be performed with that combination of fasteners 8 by which vibration is next most minimized or with that combination of fasteners 8 by which vibration is third most minimized, so that the combination of fasteners 8 used for fastening in each model need not be limited to one.

For this reason, of the plurality of fasteners 8 present, those fasteners 8 to which an immobilizing member 9 must be attached may be determined in advance. The exposure device 1 (housing 7) may be immobilized by attaching immobilizing members 9 to fasteners 8 in a combination that includes the predetermined fasteners 8 and for which vibrational amplitude is lowest, while attaching immobilizing members 9 to the fasteners 8 which it is determined in advance will be used.

In this way, an immobilizing mechanism 101 of the housing 7 according to this embodiment has a drive source (polygon motor 14); a housing 7 that holds the drive source; a number of fasteners 8 greater than a number of predetermined fastening sites on the housing 7; and an immobilizing member 9 attached to a plurality of fasteners 8 in order to immobilize the housing 7 using a combination of fasteners 8 to which the immobilizing member 9 is attached that is not a combination in which an amplitude of vibration relative to a drive speed of the drive source is greatest, there being at least one fastener 8 to which an immobilizing member 9 is not attached.

Through this, different fastening sites (fasteners 8 to which an immobilizing member 9 is attached) are used depending on the unique resonant frequency of the vibration generated in the housing 7 by the rotational speed of the drive source (polygon motor 14), and the housing 7 is immobilized with fastening sites selected so that vibration is suppressed. Thus, even when the speed of the drive source differs according to the specifications, the housing 7 can be fastened (immobilized) to the frame 6 by changing the positions of the fasteners 8 used so that vibration is effectively suppressed without adding a vibration damping member. Also, because not all of the fasteners 8 are used, the housing 7 can be fastened to the frame 6 while minimizing the number of immobilizing members 9 used and the man-hours necessary to attach the immobilizing members 9.

The immobilizing members 9 are attached to different combinations of the fasteners 8 according to the drive speed. Through this, the immobilizing members 9 are attached to different fasteners 8 in response to different unique vibrations of the housing 7 caused by the drive speed of the drive source (polygon motor 14), allowing vibration in the housing 7 to be effectively minimized.

The immobilizing members 9 may be attached to the fasteners 8 in a combination, out of the combinations of fasteners 8 to which an immobilizing member 9 is attached, such that the vibration generated by the drive source (polygon motor 14) is maximally suppressed. As the degree to which vibration can be suppressed varies depending on the combination of fasteners 8 used, the immobilizing members 9 are attached to a combination of fasteners 8 whereby vibration is maximally suppressed, allowing the housing 7 to be fastened to the frame 6 while ensuring that vibration in the housing 7 is suppressed.

Fasteners 8 are provided at a minimum of four sites, and immobilizing members 9 are attached to a minimum of three fasteners 8 so that the axis of rotation of the drive source (polygon motor 14) is located within a polygon formed by the fasteners 8 to which immobilizing members 9 are attached as seen from the immobilizing direction. Immobilizing members 9 are thereby attached to fasteners 8 so as to surround the drive source (polygon motor 14) that is the source of the vibration. Thus, it is possible to effectively suppress vibration.

Fasteners 8 are provided at five sites, at three of which an immobilizing member 9 is attached to the fastener 8. In this way, the housing 7 can be immobilized on the frame 6 while suppressing vibration with the minimum number of immobilizing points; i.e., three. Also, the number of man-hours used to immobilize the exposure device 1 can be reduced. The number of combinations can be increased the more fasteners 8 there are, but a small number of fasteners 8 is advantageous in terms of manufacturing costs. Thus, the number of fasteners 8 is set at five, allowing the number of fasteners 8 to be kept low and increases in manufacturing costs to be prevented while allowing vibration to be kept within an acceptable limit even across a variety of rotational speeds of the polygon motor 14. This allows for a balance of effectiveness and cost.

A positioning member 91 for positioning the housing 7 during fastening may be attached to those fasteners 8 to which an immobilizing member 9 is not attached. In this way, the housing 7 may be reliably positioned by attaching a positioning member 91 to those fasteners 8 to which an immobilizing member 9 is not attached.

The housing 7 that is the object of immobilizing may also be the housing 7 of the exposure device 1 that scans and exposes the photosensitive drum 31. It is thereby possible to suppress vibration in the housing 7 of the exposure device 1 and eliminate reduction in picture quality caused by vibration in the housing 7 during image formation using the photosensitive drum 31.

The present disclosure may also be considered a disclosure of an image forming apparatus having an immobilizing mechanism for a housing 7. Specifically, an image forming apparatus (e.g., a printer 100) has a photosensitive drum 31 as an image support; a polygon motor 14 as a drive source; a housing 7 that retains the polygon motor 14; a number of fasteners 8 (81 through 85) greater than a number of predetermined fastening sites on the housing 7; an immobilizing member 9 that is attached to a plurality of the fasteners 8 (81 through 85) in order to immobilize the housing 7 in a combination of the fasteners 8 (81 through 85) to which an immobilizing member 9 is attached that is not a combination in which the amplitude of vibration relative to the drive speed of the drive source is greatest, there being at least one of fastener 8 (81 through 85) to which an immobilizing member is not attached; and a frame to which the exposure device 1 is immobilized.

Through this, different fastening sites (fasteners 8 (81 through 85) to which an immobilizing member 9 is attached) are used for the immobilized resonant frequency of the vibration generated in the housing 7 by the rotational speed of the polygon motor 14, and the housing 7 of the exposure device 1 is immobilized with fastening sites selected so that vibration is minimized. Thus, even when the speed of the polygon motor 14 differs designated in the specifications, the housing 7 can be fastened (immobilized) to the frame of an image forming apparatus (e.g., a printer 100) so that vibration is effectively minimized without adding a vibration damping member by changing the positions of the fasteners 8 (81 through 85) used. Also, because not all of the fasteners 8 (81 through 85) are used, the housing 7 of the exposure device 1 can be fastened to the frame while minimizing the number of immobilizing members 9 used and the man-hours necessary to attach the immobilizing members 9. It is thereby possible to suppress vibration in the housing 7 of the exposure device 1 and eliminate reductions in picture quality caused by vibration in the housing 7 (exposure device 1) during image formation using the photosensitive drum 31.

The present disclosure may also be considered a disclosure of a method for immobilizing a housing 7. Specifically, it is an immobilizing method for a housing 7 wherein a housing 7 for retaining a drive source (polygon motor 14) that drives at a predetermined speed is immobilized on a frame 6 by attaching an immobilizing member 9 to a plurality of fasteners 8 (fastener 81 through fastener 85) provided on the housing 7, wherein an immobilizing member 9 is attached to a combination of fasteners 8 to which an immobilizing member 9 is attached that is not a combination in which the amplitude of the vibration relative to the drive speed of the drive source is greatest, there being at least one fastener 8 to which an immobilizing member 9 is not attached. Through this immobilizing method, different fastening sites (fasteners 8 to which an immobilizing member 9 is attached) are used for the vibration at the natural resonant frequency of the housing 7 as generated by the speed of the drive source, and the housing 7 is immobilized with fastening sites selected so that vibration is minimized. Thus, even when the speed of the drive source differs according to the specifications, the housing 7 can be fastened (immobilized) to the frame 6 so that vibration is effectively minimized without adding a vibration damping member by changing the positions of the fasteners 8 used. Also, because not all of the fasteners 8 are used, the housing 7 can be fastened to the frame 6 while minimizing the number of immobilizing members 9 used and the man-hours necessary to attach the immobilizing members 9.

(Second Embodiment)

Next, a second embodiment will be described with reference to FIGS. 11A through 11C and FIGS. 12A and 12B. FIGS. 11A through 11C and FIGS. 12A and 12B are illustrative views of a mark 10 for indicating whether an immobilizing member 9 is attached to a fastener 8. FIGS. 11A through 11C and FIGS. 12A and 12B are partial close-ups of one fastener 8 within the housing 7.

In this embodiment, a mark 10 is provided on the fasteners 8 to facilitate the identifying of whether an immobilizing member 9 should be attached to a fastener 8 according to the model (specifications) of the printer 100. With regards to other points, the second embodiment may be similar to the first embodiment, and any parts in common will be considered to incorporate the description of the first embodiment, with any description or drawings thereof being omitted.

In this embodiment, three (or, alternatively, four) fasteners 8 out of five provided are used according to the specifications of the printer 100 (the rotational speed of the polygon motor 14). When it is apparent to which fasteners 8 an immobilizing member 9 is attached when the exposure device 1 is actually being attached to the frame 6, a worker can attach the immobilizing members 9 without hesitation.

Figure 11A:
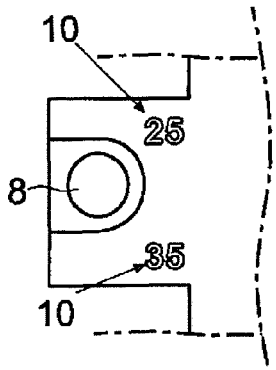
FIG. 11A is an illustrative view of an example of an engraving for showing whether or not an immobilizing member is attached to a fastener.
Figure 11B:
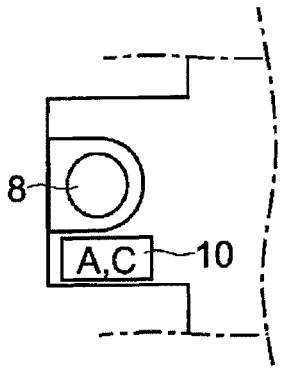
FIG. 11B is an illustrative view of an example of a decal for showing whether or not an immobilizing member is attached to a fastener.
Figure 11C:
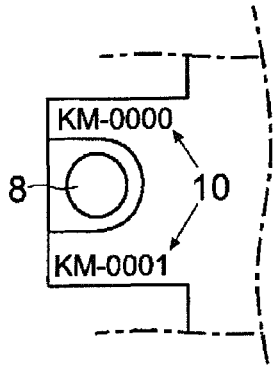
FIG. 11C is an illustrative view of an example wherein a model name is provided showing whether or not an immobilizing member is attached to a fastener.

Many forms are possible for the mark 10. FIGS. 11A through 11C offer examples of the mark 10. For example, FIG. 11A is an example wherein an engraving is applied to (engraved on) the fastener 8 as a mark 10. In FIG. 11A, for example, the number of sheets printable in a unit of time (one minute) by the model of printer 100 or multifunction peripheral in which the housing 7 is used is displayed as a mark 10. For example, when the fastener 8 shown in FIG. 11A is a fastener 8 used in a model that prints twenty-five or thirty-five sheets per minute, a mark 10 showing the model such as a "25" or a "35" is placed on the fastener 8. Thanks to this, a worker can know to fasten a fastener 8 bearing the mark 10 when on a manufacturing line for a model printing twenty-five or thirty-five sheets per minute.

FIG. 11B is an example of a decal applied to each fastener 8 as a mark 10. In FIG. 11B, for example, a format with a predetermined letter (pattern A, pattern B, etc.; a number may also be used) is provided as a mark 10 according to the combination of fasteners 8 to which an immobilizing member 9 is attached. In the current manufacturing line, for example, it is decided in advance that a pattern A of fasteners 8 will be used. A worker then knows to fasten fasteners 8 bearing the mark 10 of the selected pattern.

FIG. 11C shows an example of a mark 10 drawn on a fastener 8. In FIG. 11C, for example, the model name of the printer 100 or multifunction peripheral in which the housing 7 (exposure device 1) is used is displayed as a mark 10. When, for example, the fastener 8 in FIG. 11C uses in a model named "KM-0000" or "KM-0001", a mark 10 indicating model KM-0000 or KM-0001 is drawn. Thanks to this, a worker can know which fasteners 8 to fasten depending upon the model being produced on the manufacturing line to which the worker is assigned.

The mark 10 of the fasteners 8 can be a number showing the number of sheets printed per unit of time (one minute) by the model being manufactured, a format (pattern) of the fasteners 8 to which an immobilizing member 9 is attached, a model name, or the like, and can be provided as an engraving, decal, printed mark, or other method.

Figure 12A:
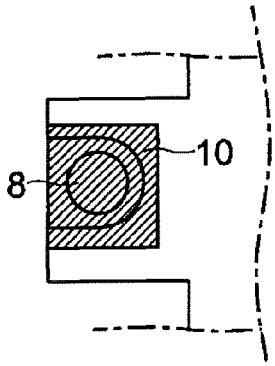
FIG. 12A is an illustrative view of an example of a decal for showing whether or not an immobilizing member is attached to a fastener.

As shown in FIG. 12A, the mark 10 showing whether or not an immobilizing member 9 is attached to a fastener 8 need not only be an identifying mark such as a number or letter, but can also block a fastener 8 not being used. Such blocking may be performed by applying a decal, or by not creating an opening in the fastener 8 when the housing 7 is being manufactured depending on the model in which the housing 7 is used.

The mark 10 is not limited to the examples given above, and may be of any form as long as it enables one to identify whether or not to attach an immobilizing member 9 according to the rotational speed of the polygon motor 14 as dictated by the specifications of the printer 100.

Figure 12B:
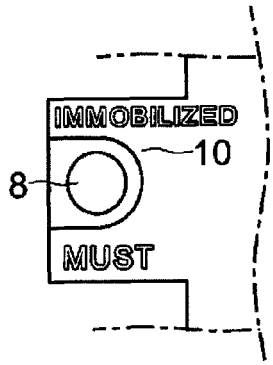
FIG. 12B is an illustrative view of an example of an engraving for showing whether or not an immobilizing member is attached to a fastener.

It is also possible to immobilize the exposure device 1 (housing 7) by immobilizing immobilizing members 9 to a combination of fasteners 8 in which vibrational amplitude is minimized, while using those immobilized fasteners 8 to which it has been decided in advance that an immobilizing member 9 will be attached. As shown in FIG. 12B, a mark 10, such as "IMMOBILIZED" or "MUST", indicating that an immobilizing member 9 must be attached may be applied to these immobilized (necessary) fasteners 8 (an engraving in the example of FIG. 12B; the mark 10 may be a decal, or the mark 10 may be printed.).

In this way, the drive source (polygon motor 14) of the immobilizing mechanism 101 of the housing 7 of this embodiment has a minimum of two predetermined drive speeds, and a mark 10 shows whether or not to attach an immobilizing member 9 to a fastener 8 depending on the predetermined drive speed of the drive source (polygon motor 14). It is thereby possible to visually confirm which fasteners 8 to attach an immobilizing member 9 to in which specifications. Thus, an immobilizing member 9 can be attached to those fasteners 8 capable of suppressing vibration without error.

In the fastening method of this embodiment, a mark 10 may be applied to a fastener 8 in order to show whether or not to attach an immobilizing member 9 depending on the drive speed of the drive source (polygon motor 14). Using this method, it is possible to visually confirm which fasteners 8 to attach an immobilizing member 9 to in which specifications. Thus, an immobilizing member 9 can be attached to those fasteners 8 capable of suppressing vibration without error.

Of the fasteners 8, one or a plurality of fasteners 8 may be designated as an immobilized fastener 8 to which an immobilizing member 9 is always attached. An immobilizing member 9 is thereby always attached to some of those fasteners 8 to which an immobilizing member 9 is attached, and the remaining fasteners 8 can be fastened according to the speed of the drive source (polygon motor 14) so that vibration in the housing 7 can be reduced. Some of the fasteners 8 are immobilized no matter what the model, enabling errors in the fasteners 8 used (mistakes in fastening sites) to be avoided.

(Third Embodiment)

Figure 13A:
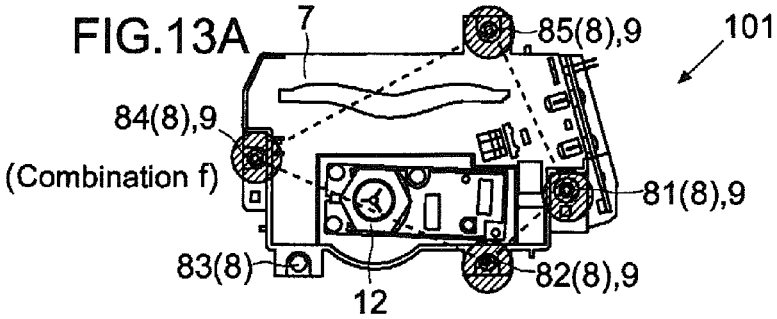
FIG. 13A is an illustrative view of one example of a combination f of fasteners used to immobilize a housing.
Figure 13B:
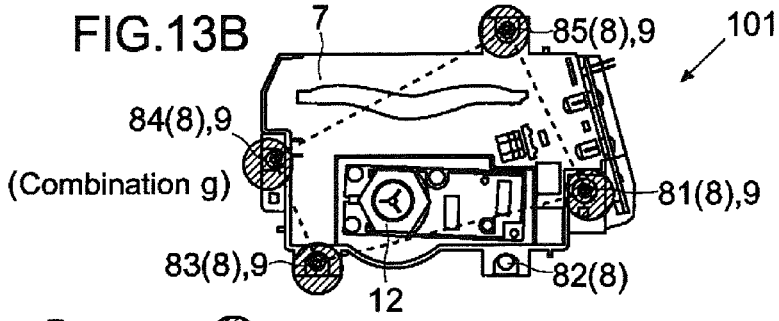
FIG. 13B is an illustrative view of one example of a combination g of fasteners used to immobilize a housing.
Figure 13C:
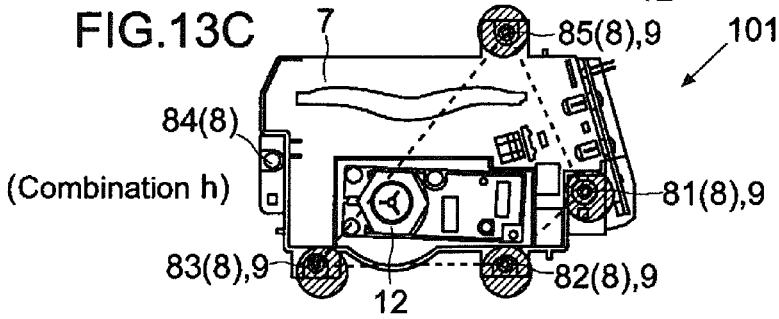
FIG. 13C is an illustrative view of one example of a combination h of fasteners used to immobilize a housing.
Figure 13D:
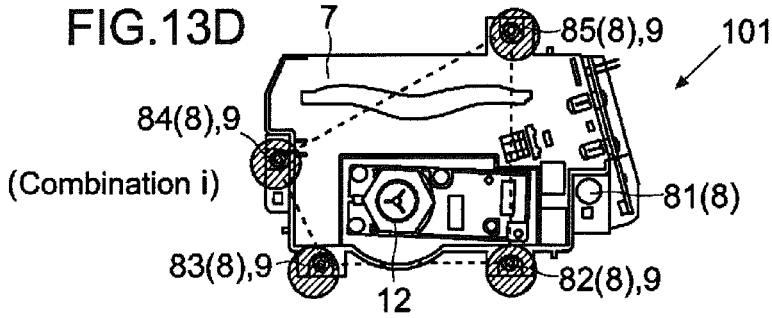
FIG. 13D is an illustrative view of one example of a combination i of fasteners used to immobilize a housing.
Figure 13E:
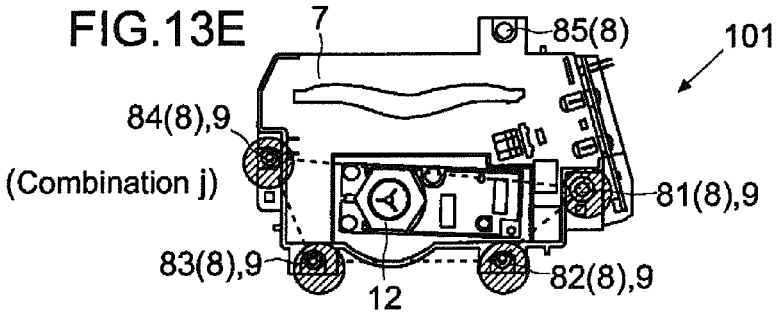
FIG. 13E is an illustrative view of one example of a combination j of fasteners used to immobilize a housing.
Figure 14:
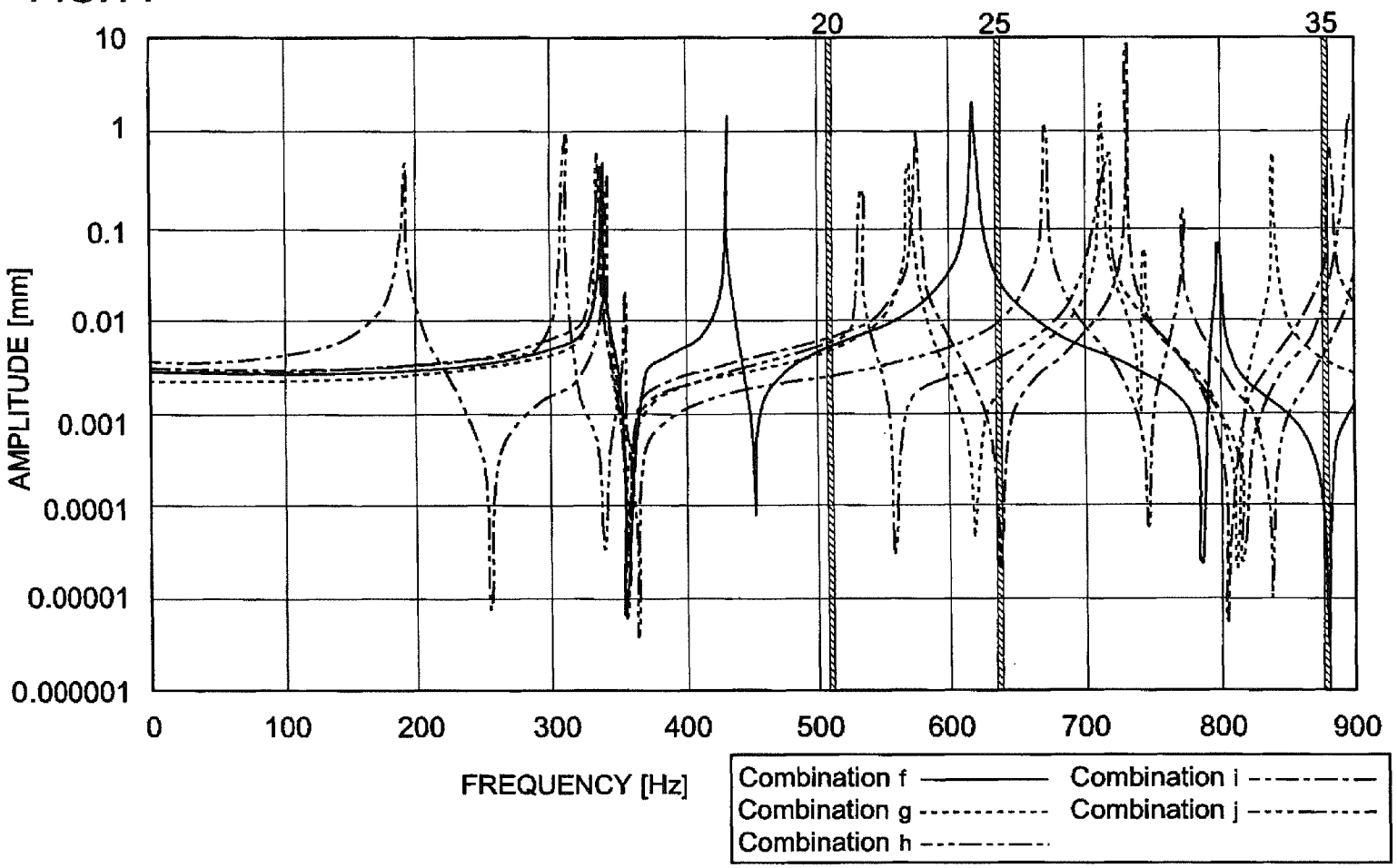
FIG. 14 is a graph illustrating one example of an amplitude of vibration generated in a housing as the drive speed of a polygon motor increases for each combination of fasteners used to immobilize the housing.

Next, a third embodiment will be described with reference to FIGS. 13 and 14. FIGS. 13A through 13E are illustrative views of one example of a combination of fasteners 8 used to immobilize a housing 7. FIG. 14 is a graph illustrating one example of an amplitude of vibration generated in a housing 7 as the drive speed of a polygon motor 14 increases for each combination of fasteners 8 used to immobilize the housing 7.

In the example of the first embodiment, three fasteners 8 out of five provided were used. In the third embodiment, an example wherein four fasteners 8 out of five provided are used will be described. With regards to other points, the third embodiment may be similar to the first embodiment and the second embodiment, and any parts in common will be considered to incorporate the description of the first embodiment and the second embodiment, with any description or drawings thereof being omitted.

In the third embodiment, four fasteners 8 out of five provided are used. When an immobilizing member 9 is applied to all five fasteners 8, there is the possibility that vibration will be suppressed to a greater extent. However, depending on the rotational speed of the polygon motor 14, which varies according to model, vibrational amplitude may increase beyond an acceptable limit. When vibration increases in this way even when five fasteners 8 are used, a vibration damping member is used as in conventional methods. It may be possible to suppress vibration of the housing 7 caused by the polygon motor 14 by deliberately not using all the fasteners 8, and fastening using a combination of a reduced number of specific fasteners 8. It is thereby possible to suppress vibration in the housing 7 while reducing the number of immobilizing members 9 and minimizing the number of man-hours needed to perform immobilizing.

In the third example as well, a certain rule dictates the fasteners 8 that are used, as shown in FIGS. 13*a* through 13E. In FIGS. 13A through 13E, dotted lines connect the fasteners 8 to which an immobilizing member 9 is attached in order to show the fastening sites. The rule is that an immobilizing member 9 is attached to a combination of fasteners 8 wherein, as seen from the direction from which the immobilizing member 9 is immobilized (from above the exposure device 1), four (adjacent) fasteners 8 out of the five fasteners 8 to which an immobilizing member 9 is attached form a polygon (quadrangle) in which the rotational axis of the polygon motor 14 is located. This makes it easier to suppress vibration in the polygon motor 14, which is the source of the vibration.

In the following description, the fastening pattern formed by the combination of fasteners 8 used in FIG. 13A (fastener 81, fastener 82, fastener 84, and fastener 85) will be labelled combination f. The fastening pattern formed by the combination of fasteners 8 used in FIG. 13B (fastener 81, fastener 83, fastener 84, and fastener 85) will be labelled combination g. The fastening pattern formed by the combination of fasteners 8 used in FIG. 13C (fastener 81, fastener 82 fastener 83, and fastener 85) will be labelled combination h. The fastening pattern formed by the combination of fasteners 8 used in FIG. 13D (fastener 82, fastener 83, fastener 84, and fastener 85) will be labelled combination i. The fastening pattern formed by the combination of fasteners 8 used in FIG. 13E (fastener 81, fastener 82, fastener 83, and fastener 84) will be labelled combination j.

FIG. 14 is a graph showing one example of the relationship between the frequency of the vibration (horizontal axis) exhibited in the housing 7 and the amplitude thereof (vertical axis) at the fastening sites of each combination when the drive speed (rotational speed) of the polygon motor 14 is altered. In FIG. 14, the relationship between vibrational frequency and amplitude for the fastening sites of combination f is shown by a solid line, for combination g by a dotted line, for combination h by a double-dotted-single-dashed line, for combination i by a single-dotted-single-dashed line, and for combination j by a triple-dotted-single-dashed line.

As in FIG. 10, The striped line labelled 20 illustrates the frequency of the vibration exhibited by the housing 7 (approx. 510 Hz) when the polygon motor 14 is rotated at a predetermined speed corresponding to a model whose specifications permit twenty sheets to be printed per minute. The striped line labelled 25 illustrates the frequency of the vibration exhibited by the housing 7 (approx. 630 Hz) when the polygon motor 14 is caused to rotate at a predetermined speed corresponding to a model whose specifications permit twenty-five sheets to be printed per minute. The striped line labelled 35 illustrates the frequency of the vibration exhibited by the housing 7 (approx. 880 Hz) when the polygon motor 14 is caused to rotate at a predetermined speed corresponding to a model whose specifications permit thirty-five sheets to be printed per minute.

In the case of, for example, a model whose specifications allow twenty sheets to be printed per minute, vibrational amplitude is greatest when combination i (single-dotted-single-dashed line) or combination j (triple-dotted-single-dashed line) is used for fastening. On the other hand, fastening using combination h (double-dotted-single-dashed line) allows the vibrational amplitude of the housing 7 to be suppressed compared to other models.

On the other hand, in the case of, for example, a model whose specifications allow thirty-five sheets to be printed per minute, fastening using combination i (single-dotted-single-dashed line) or combination j (triple-dotted-single-dashed line) should be avoided due to the relationship with vibration, and fastening using combination f (solid line) is most preferable.

Moreover, in the case of for example, a model whose specifications allow twenty-five sheets to be printed per minute, fastening using combination f (solid line) or combination h (double-dotted-single-dashed line) should be avoided due to the relationship with vibration. Fastening using combination g (dotted line) or combination i (single-dotted-single-dashed line) is most preferable.

In this embodiment as well, the question of which fasteners 8 are used for fastening (by attaching an immobilizing member 9) can be determined as desired. It is preferable that a combination of fasteners 8 such that vibration is most minimized at the speed of the polygon motor 14 for each model. When, however, vibration remains within an acceptable limit, for example, fastening of the housing 7 may be performed with that combination of fasteners 8 by which vibration is next most minimized or with that combination of fasteners 8 by which vibration is third most minimized in this embodiment as well, so that the combination of fasteners 8 used for fastening in each model need not be limited to one.

In this way, effects similar to those of the first embodiment may be obtained using the third embodiment as well.

Fasteners 8 are provided at five sites, at four of which an immobilizing member 9 is attached to the fastener 8. In this way, the housing 7 can be firmly immobilized on the frame 6 while suppressing vibration by immobilizing at four points. The number of combinations can be increased the more fasteners 8 there are, but a low number of fasteners 8 is advantageous in terms of manufacturing costs. Thus, the number of fasteners 8 is set at five, allowing the number of fasteners 8 to be kept low and increases in manufacturing costs to be prevented while allowing vibration to be kept within an acceptable limit even across a variety of rotational speeds of the polygon motor 14. This allows for a balance of effectiveness and cost.

Next, another embodiment will be described. In the embodiments described above, five fasteners 8 (fastener 81 through fastener 85), and some of those fasteners 8 were used to immobilize the housing 7 to the frame 6. However, the number of fasteners 8 provided need not be limited to five. For example, four fasteners 8 may be provided, and an immobilizing member 9 attached to three of those fasteners 8. There may also be six or more fasteners 8 (e.g., 10), and an immobilizing member 9 may be attached to a combination of fasteners 8 that enables suppression of the frequency of the vibration generated by the polygon motor 14 (drive source), with not all fasteners 8 being used.

For example, when a comparatively large number of fasteners 8, such as ten, is provided, it is easier to predetermine those fasteners 8 out of the plurality of fasteners 8 to which an immobilizing member 9 must be attached. The exposure device 1 (housing 7) may be immobilized by attaching immobilizing members 9 (e.g., approx. 3 to 5) to a combination of fasteners 8 allowing vibrational amplitude to be suppressed while using the predetermined immobilized fasteners 8.

The foregoing was a description of embodiments according to the present disclosure, but the scope of the disclosure is not limited to these, and various modifications within the spirit of the disclosure may be made.

What is claimed is:

1. A housing immobilizing mechanism comprising:

a drive source having at least two predetermined drive speeds;

a housing for holding the drive source, having a plurality of predetermined fastening sites;

a plurality of fasteners more numerous than the plurality of predetermined fastening sites on the housing; and an immobilizing member attached to a plurality of the fasteners in order to immobilize the housing using a combination of fasteners that is not a combination in which an amplitude of vibration relative to a drive speed of the drive source is greatest; wherein, at least one of the plurality of fasteners is not attached to an immobilizing member and at least a portion of the plurality of fasteners are marked so as to indicate whether or not an immobilizing member is to be attached depending on the predetermined drive speed with the drive source.

2. The housing immobilizing mechanism according to claim 1, wherein:

the immobilizing member is attached to a different combination of fasteners according to individual drive speeds.

3. The housing immobilizing mechanism according to claim 1, wherein:

the immobilizing member is attached to a combination of the fasteners, such that vibration generated by the driving of the drive source is maximally suppressed.

4. The housing immobilizing mechanism according to claim 1, wherein:

fasteners arc provided at a minimum of four sites; and immobilizing members are attached to a minimum of three fastener sites so that the axis of rotation of the drive source is located within a polygon linking adjacent fasteners to which the immobilizing members are attached, as seen from the direction of immobilizing.

5. The housing immobilizing mechanism according to claim 4, wherein:

fasteners are provided at five sites; and the immobilizing member is attached to three or four fastener sites.

6. The housing immobilizing mechanism according to claim 1, wherein:

a positioning member for positioning the housing during fastening is attached to those fasteners to which an immobilizing member is not attached.

7. The housing immobilizing mechanism according to claim 1, wherein:

the housing is a housing of an exposure device for scanning and exposing a photosensitive drum.

8. An image forming apparatus comprising:

a photosensitive drum constituting an image support; and an exposure device for scanning and exposing the photosensitive drum, the exposure device having a polygon motor as a drive source having at least two predetermined drive speeds; a housing having a plurality of predetermined fastening sites for holding the polygon motor; a plurality of fasteners greater than the plurality of fastening sites on the housing; and an immobilizing member attached to a plurality of the fasteners in order to immobilize the housing using a combination of fasteners that is not a combination in which an amplitude of vibration relative to a drive speed of the drive source is greatest, wherein, at least one of the plurality of fasteners is not attached to an immobilizing member and at least a portion of the plurality of fasteners are marked so as to indicate whether or not an immobilizing member is to be attached depending on the predetermined drive speed with the drive source.

9. A housing immobilizing method comprising:

attaching an immobilizing member to a plurality of fasteners provided on a housing holding a drive source of a predetermined speed, and immobilizing the housing on a frame;

wherein at least a portion of the plurality of fasteners are marked so as to indicate whether or not the immobilizing member is to he attached depending on the predetermined drive speed of the drive source; and wherein the immobilizing member is attached to the fasteners marked for the drive speed of the drive source installed in the housing and using a combination of fasteners that is not a combination in which an amplitude of vibration relative to a drive speed of the drive source is greatest, and there being at least one fastener to which an immobilizing member is not attached.

10. The housing immobilizing method according to claim 9, comprising:

attaching the immobilizing member to a different combination of fasteners according to individual drive speeds.

11. The housing immobilizing method according to claim 9, comprising:

attaching the immobilizing member to a combination of the fasteners, such that vibration generated by the driving of the drive source is maximally suppressed.

12. The housing immobilizing method according to claim 9, comprising:

providing the fasteners at a minimum of four sites; and attaching the immobilizing members to a minimum of three fastener sites so that the axis of rotation of the drive source is located within a polygon linking adjacent fasteners to which the immobilizing members are attached, as seen from the direction of immobilizing.

13. The housing immobilizing method according to claim 12 comprising:

providing the fasteners in five sites; and attaching the immobilizing member to three or four fastener sites.

14. The housing immobilizing method according to claim 9, comprising:

having one or a plurality of the fasteners be immobilized fasteners that are immobilized and have the immobilizing member attached thereto.

15. The housing immobilizing method according to claim 9, comprising:

attaching, to fasteners not having an immobilizing member attached thereto, a positioning member for positioning the housing during fastening.

* * * * *